US009670759B2

(12) United States Patent
Lee et al.

(10) Patent No.: US 9,670,759 B2
(45) Date of Patent: Jun. 6, 2017

(54) MONITORING FLUID FLOW IN A DOWNHOLE ASSEMBLY

(71) Applicants: Erik N. Lee, Houston, TX (US); William Johnston, Blacksburg, VA (US); Daniel Boyd Cooper, Christiansburg, VA (US)

(72) Inventors: Erik N. Lee, Houston, TX (US); William Johnston, Blacksburg, VA (US); Daniel Boyd Cooper, Christiansburg, VA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 249 days.

(21) Appl. No.: 14/518,798

(22) Filed: Oct. 20, 2014

(65) Prior Publication Data

US 2015/0144333 A1 May 28, 2015

Related U.S. Application Data

(60) Provisional application No. 61/908,361, filed on Nov. 25, 2013.

(51) Int. Cl.
*E21B 47/10* (2012.01)
*E21B 43/14* (2006.01)

(52) U.S. Cl.
CPC ..... *E21B 43/14* (2013.01); *E21B 47/101* (2013.01)

(58) Field of Classification Search
CPC ..... E21B 43/14; E21B 47/101
See application file for complete search history.

(56) References Cited

U.S. PATENT DOCUMENTS

2004/0006429 A1 1/2004 Brown
2004/0084180 A1* 5/2004 Shah ..... E21B 47/10 166/250.16
2004/0256100 A1 12/2004 Tubel et al.
2010/0018703 A1 1/2010 Lovell et al.
2012/0018149 A1 1/2012 Fidan et al.
2012/0046866 A1 2/2012 Meyer et al.

OTHER PUBLICATIONS

International Search Report and Written Opinion for PCT Application No. PCT/US2014/061554, dated Jan. 21, 2015, pp. 1-12.

* cited by examiner

*Primary Examiner* — Brad Harcourt
(74) *Attorney, Agent, or Firm* — Cantor Colburn LLP

(57) ABSTRACT

A method of monitoring fluid flow in a borehole includes measuring acoustics at a plurality of locations along a downhole assembly in a borehole and calculating a fluid flow rate at the plurality of locations along the downhole assembly based on measuring the acoustics at the plurality of locations.

17 Claims, 3 Drawing Sheets

MONITORING FLUID FLOW IN A DOWNHOLE ASSEMBLY

CROSS-REFERENCE TO RELATED APPLICATION

This application claims the benefit of priority of U.S. Provisional Application No. 61/908,361 filed Nov. 25, 2013, the disclosure of which is incorporated by reference herein in its entirety.

BACKGROUND

The present application relates to downhole assemblies in wellbores, and in particular to monitoring fluid in a downhole assembly with a distributed acoustic sensor.

Downhole assemblies for well stimulation operations and production operations include perforations to permit fluid flow between the downhole assembly and the surrounding earth formation. Examples of well stimulation operations include operations to clean the well, to create or extend passages or wormholes in an earth formation, or to otherwise increase the permeability of the earth formation. The flow of fluid within the downhole assembly and between the downhole assembly and the earth formation varies during operation based on various factors, including the permeability of the earth formation, the stage (early or later) of a well stimulation process, physical obstructions, such as loose solid earth material, which may cause blockages to fluid flow, and various other factors. Thus, different regions including the perforations along the downhole assembly may have different fluid flow characteristics based on the above-described factors.

SUMMARY

According to an embodiment of the invention, a method of monitoring fluid in a borehole includes measuring acoustics at a plurality of locations along a downhole assembly in a borehole and calculating a fluid flow rate at the plurality of locations along the downhole assembly based on measuring the acoustics at the plurality of locations.

According to another embodiment of the invention, a wellbore system includes a downhole assembly having a plurality of locations along the downhole assembly that include perforations to permit fluid flow between an inside of the downhole assembly and an earth formation. The downhole assembly includes a distributed sensor assembly configured to measure acoustics at the plurality of locations. The system includes a fluid flow monitor to measure a total fluid flow rate of fluid injected into or leaving the downhole assembly. The system also includes a computer configured to calculate a fluid flow rate at the plurality of locations along the downhole assembly based on measurements from the distributed sensor assembly corresponding to the acoustics at the plurality of locations, and based on the total fluid flow rate.

According to yet another embodiment of the invention, a method of monitoring fluid flow in a borehole includes measuring acoustics at a plurality of locations along a tubing or casing in the borehole; and calculating a fluid flow rate at the plurality of locations along the tubing or casing based on measuring the acoustics at the plurality of locations.

BRIEF DESCRIPTION OF THE DRAWINGS

Referring now to the drawings wherein like elements are numbered alike in the several Figures.

DETAILED DESCRIPTION

The flow of fluid in downhole assemblies varies according to numerous factors along a length of the downhole assembly, and in particular regions of the downhole assembly that include perforations to permit fluid flow between the downhole assembly and the surrounding earth formation. Embodiments of the invention relate to a distributed acoustic sensor assembly that determines fluid flow rates along the downhole assembly. Additional embodiments relate to using the distributed acoustic sensor assembly to determine the fluid flow rates of axial flow.

Figure 1:
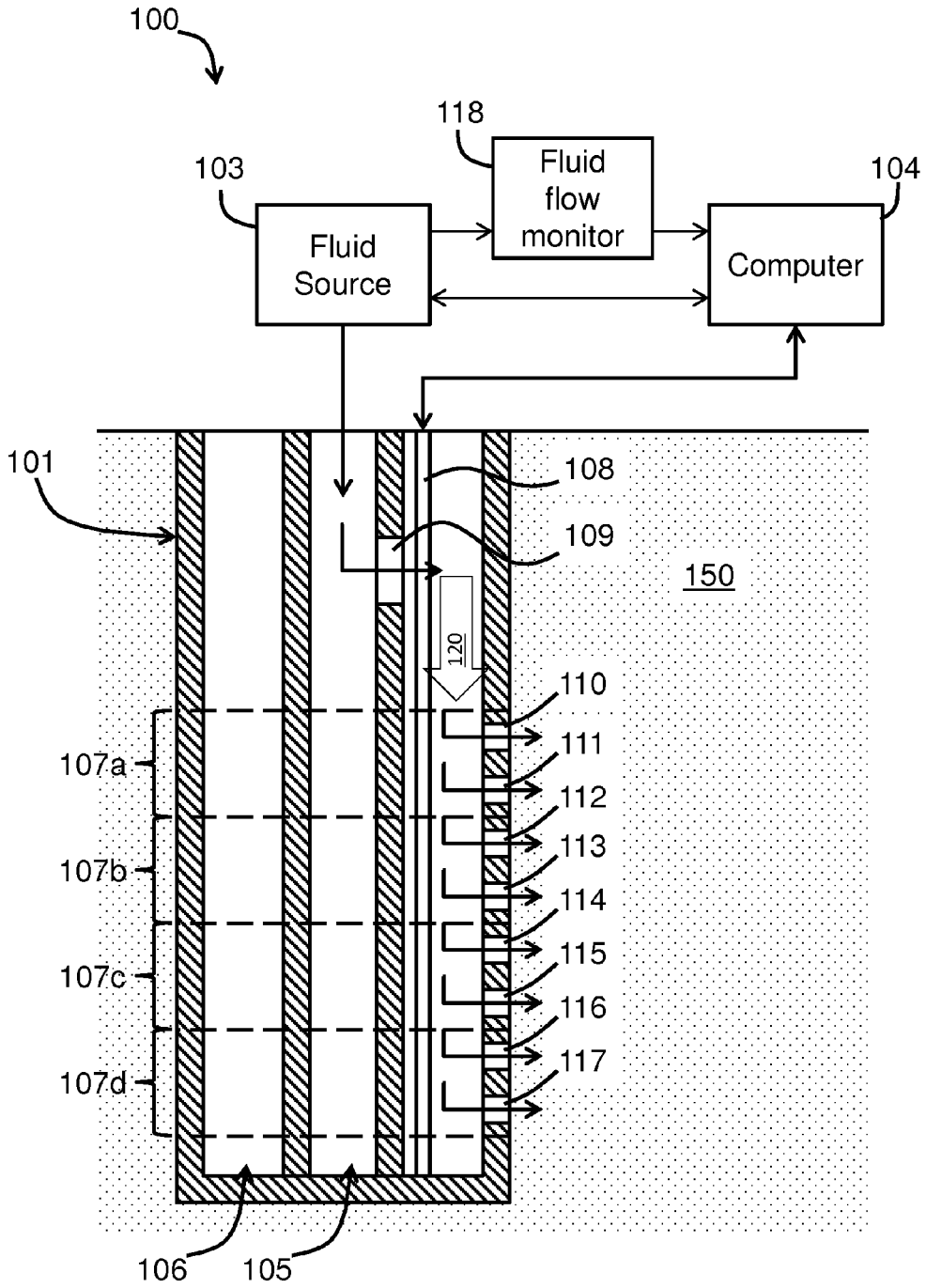
FIG. 1 illustrates a downhole assembly according to an embodiment of the invention.

FIG. 1 illustrates a borehole system 100 according to an embodiment of the invention. The system includes a downhole assembly 101, which receives a fluid 102 from a fluid source 103, and a computer 104 configured to perform one or both of monitoring of the downhole assembly 101 and the fluid 102 and control of the downhole assembly 101 and fluid 102. In one embodiment, a flow monitor 118 is provided to monitor fluid flow at the surface and to provide the fluid flow data to the computer 104. The fluid source 103 includes one or more of fluid tanks or reservoirs, pumps, valves, and any other structures to store fluid and adjust a rate of fluid flow into the downhole assembly 101.

In embodiments of the invention, the downhole assembly 101 may include any type of downhole assembly including a wellbore completion assembly to transmit fluids from the formation 150 to the surface, a fluid-injection assembly to transmit fluids from the surface into the formation 150, or any other type of downhole assembly 101. In one embodiment, the downhole assembly 101 is a stimulation assembly, such as an acid stimulation assembly, configured to inject fluid into the formation 150 via the downhole assembly 101 to change physical characteristics of the formation 150 to stimulate the flow of desired fluids, such as hydrocarbons, from the formation 150 to the surface.

In one embodiment, the downhole assembly 101 includes an inner channel 105 (defined by production tubing) and an outer, annular channel 106 defined by an outer casing of the downhole assembly 101. An opening 109 between the inner channel 105 and the outer, annular channel 106 is opened and closed by a valve (not shown) or any other control mechanism to control fluid flow between the inner and outer channels 105 and 106.

While FIG. 1 illustrates a downhole assembly 101 having an inner channel 105 and an outer channel 106, embodiments of the invention encompass any downhole assembly having any structures for permitting fluid flow into or out from the downhole assembly. In particular, embodiments of the invention encompass downhole assemblies that inject fluid from the surface (i.e. outside the borehole) into an earth formation, or that transmits fluid from an earth formation to the surface.

The downhole assembly 101 includes perforations 110-117 for permitting fluid flow between the downhole assembly 101 and the formation 150. In particular, FIG. 1 illustrates a fluid source 103 that transmits fluid 102 to the inner channel 105, through the opening 109 to the outer, annular channel 106, and from the outer, annular channel 106 into the earth formation 150. A distributed sensor array 108 is located in the outer, annular channel 106 for detecting acoustic waves generated by the fluid 102 in the downhole assembly 101. In one embodiment, the distributed sensor array 108 is an optical fiber. However, embodiments of the invention encompass any type of sensor array. The distributed sensor array 108 may be separated from the side walls of the downhole assembly 101 or rigidly attached to the walls.

The distributed sensor array 108 detects acoustic waves at a plurality of zones 107*a*, 107*b*, 107*c*, and 107*d*, each zone 107*a*-107*d* corresponding to one or more perforations 110-117. For example, in one embodiment, each zone 107*a*-107*d* corresponds to a predetermined length, such as between 1 meter and 10 meters along the downhole assembly 101. However, embodiments of the invention are not limited to only four zones, and embodiments of the invention encompass zones of any predetermined length according to a desired resolution of downhole data. In an embodiment in which the distributed sensor assembly 108 is an optical fiber, the computer 104 may generate signals at varying wavelengths to survey each zone 107*a*-107*d* in sequence. As the acoustic waves of the fluid 102 alter the characteristics of the optical fiber in each zone 107*a*-107*d*, the computer obtains different data corresponding to different acoustic waves in each zone 107*a*-107*d*. The computer 104 analyzes the different data to determine different flow rates in each zone 107*a*-107*d*, and the computer 104 determines a flow distribution in the downhole assembly 101. The computer 104, or another computer, may further control operation of one or both of the fluid source 103 and the downhole assembly 101 based on the flow distribution data.

During operation of the downhole assembly 101 numerous acoustic sources exist that may be detected by the distributed sensor array 108. First, turbulent flow noise is generated in the outer, annular cavity 106 due to the fluid 102 flowing through the outer, annular cavity 106 and interacting with the walls of the cavity 106. The turbulent flow noise exists all along the downhole assembly 101. A second source of acoustic noise is noise generated by any flow path changes, such as by fluid 102 flowing through the opening 109 or any other openings or valves. A third acoustic source includes the fluid flowing through the perforations 110-117. While three examples of acoustic noise are provided, it is understood that numerous sources of acoustic noise exist in the downhole environment, and any of these sources may be detected by the distributed sensor array 108.

In one embodiment, the acoustic noise caused by flow path changes, such as valves or openings, is identified and cancelled out in any analysis of flow distribution. In an embodiment in which the flow of the fluid 102 through the perforations 110-117 is the subject of analysis, the noise generated by flow path changes other than the perforations 110-117 may be identified as background noise of a known frequency, and may be cancelled out and omitted from any analysis of the flow rate of fluid 102 through the perforations 110-117.

Figure 2:
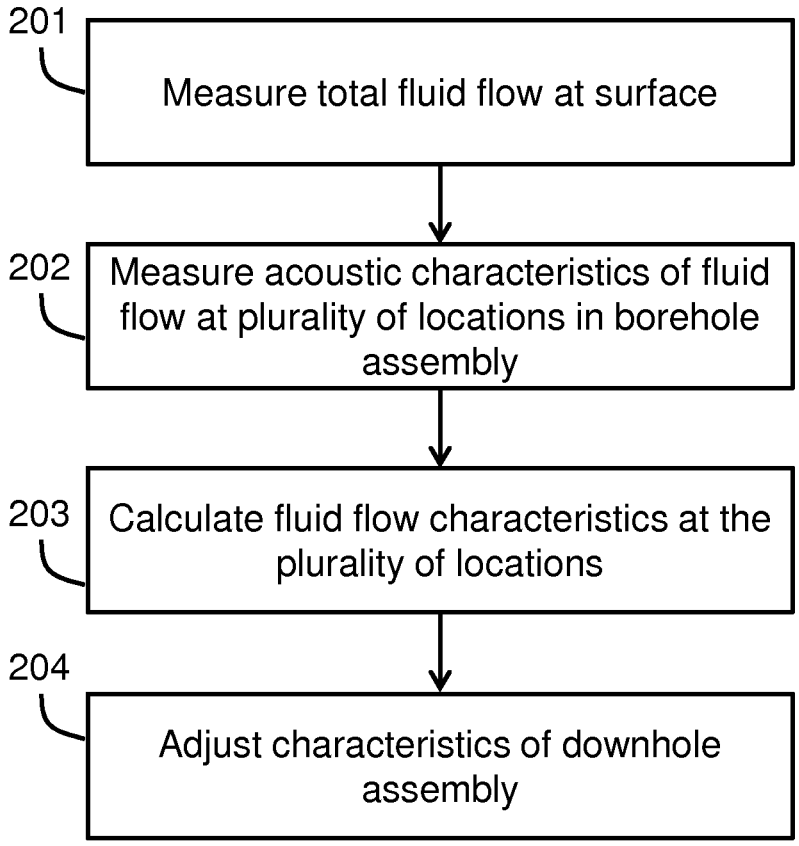
FIG. 2 is a flow diagram of a method according to an embodiment of the invention.

Referring to FIGS. 1 and 2, in one embodiment, the computer 104 is configured to measure the flow of fluid 102 at the surface, or outside the borehole in which the downhole assembly 101 is located (block 201). In block 202, the computer 104 measures the acoustic characteristics of fluid flow at a plurality of locations, such as the plurality of zones 107*a*-107*d*, in the downhole assembly 101. In one embodiment, measuring the acoustic characteristics includes transmitting signals at predetermined frequencies into a distributed acoustic sensor 108, such as an optical fiber, to obtain acoustic data corresponding to different predetermined zones or regions in the downhole assembly 101. The reflected signal detected by the computer 104 is altered according to the acoustic effects of the fluid flow in the respective zones 107*a*-107*d* on the distributed acoustic sensor 108 in that zone 107*a*-107*d*. In one embodiment, the received reflected signal is analyzed as a root means square (RMS) value. In one embodiment, the reflected energy is detected over a predetermined period of time.

In block 203, the computer 104 calculates fluid flow characteristics at the plurality of zones 107*a*-107*d* in the downhole assembly 101 based on the detected acoustic characteristics. In one embodiment, calculating the fluid flow characteristics includes filtering out from the calculations the fluid flow noise that does not correspond to any of the zones 107*a*-107*d* having perforations 110-117 located therein. In other words, since the fluid flow through the perforations 110-117 is the target region for analysis, other acoustic sources, such as noise from fluid flow through the cavity 106 or fluid flow through the opening 107 may be filtered out from the analyzed fluid flow noise prior to calculating the fluid flow characteristics at the plurality of zones 107*a*-107*d*.

In one embodiment, the acoustic noise from fluid flowing through the outer, annular cavity 106 is ignored, or not filtered, since this noise may be insignificant relative to the noise from fluid flow through the perforations 110-117. In addition, in some embodiments, fluid flow changes, such as fluid flowing through valves, generates noise at known frequencies, and this noise is filtered out from the calculation, such as by cancelling out the signal at the predetermined frequency corresponding to the fluid flow change. While one example of a method for cancelling out noise is provided, embodiments of the invention encompass any methods for cancelling out noise in regions other than the zones 107*a*-107*d* having the perforations 110-117 located therein. In another embodiment, linear coherence is estimated over multiple neighboring channels to separate acoustic noise sources.

In embodiments of the invention, the known or observed characteristics of the fluid 102 in the downhole assembly 101 are taken into account to determine the fluid flow rates in the zones 107*a*-107*d* having the perforations 110-117 located therein. For example, in any given zone 107*a*-107*d* within the wellbore assembly 101, the velocity of fluid in the annular cavity 106 decreases as the fluid 102 travels downhole through the zone 107*a*-107*d*. The decrease in fluid velocity is due to the removal of fluid from the stream in the annular cavity 106 to enter the earth formation 150. Since the acoustic characteristics generated by the fluid 102 change according to the change in velocity, the change in acoustic characteristics is used to calculate the fluid flow characteristics in each zone 107*a*-107*d*.

Other noise, such as mechanical, optical, or electric noise may also be filtered from the data collected by the distributed sensor array 108.

Once the noise corresponding to the perforations 110-117 has been isolated, the computer 104 determines signal energy corresponding to the isolated perforation acoustic noise by computing an estimate of signal energy over a predetermined period of time. In one embodiment, a root mean square (RMS) calculation is performed to represent the signal energy detected by the distributed sensor array 108 in one of the zones 107*a*-107*d* over the predetermined period of time, where the signal energy corresponds to the isolated acoustic noise of the perforations 110-117. For example, if the RMS calculation is performed for the zone

107*a*, then the RMS would be calculated based on signal energy corresponding to the acoustic noise from the perforations 110 and 111.

The RMS acoustic energy for specific frequency bands is related to the fluid flow velocity. Depending on the flow regime and the source of the flow induced acoustics, different frequency bands may be more highly correlated with fluid flow velocity. While there are a number of non-dimensional scaling methods that may be employed to determine the frequency bands which best relate flow velocity to acoustic energy, an exemplary method involves the acoustic signal being decomposed into user-defined frequency bands. Standard one-third octave bands are an example but the method is not limited to any specific decomposition of frequency bands. Once a set of frequency bands are selected, the correlation between the acoustic energy from each frequency band and the time-varying flow velocity is assessed to determine the bands of energy that have the highest correlation. This correlation may be linear or non-linear and is not restricted to a given functional form. The frequency bands or bands of energy that show a sufficiently strong correlation are then combined to produce a composite RMS band. The RMS energy associated with these combined frequency bands may then be used in the further processing and calibration steps described below.

In one embodiment, calibration of the RMS to fluid flow, data corresponding to each perforation 110-117, or to each zone 107*a*-107*d* including the perforations 110-117 is summed over each time step, or each predetermined period of time. For example, a total RMS over time period t1 ($RMS_{t1,\ tot}$) is calculated by summing the RMS of each of the zones 107*a*-107*d* ($RMS_a$, $RMS_b$, $RMS_c$, $RMS_d$) over the time period t1, such that $RMS_{tot,t1}=RMS_{a,t1}+RMS_{b,t1}+RMS_{c,t1}+RMS_{d,t1}$. A calibration ratio is computed by dividing the total measured flow rate ($Q_{tot,\ t1}$) at the surface by the summed RMS ($RMS_{tot,\ t1}$)of all of the zones for a single time step, for example time step t1.

The calibration ratio may be multiplied by each individual RMS ($RMS_{a,t1}$, $RMS_{b,t1}$, $RMS_{c,t1}$, $RMS_{d,t1}$) to produce an estimate of the flow rate into, or out from, the perforations of each zone 107*a*-107*d*. For example, the flow rate for zone 107*a* at time step t1 may be calculated according to the equation: $Q_{a,t1}=(Q_{tot,t1}/\ RMS_{tot,t1})^*\ RMS_{a,t1}$. By repeating the process for each zone 107*a*-107*d*, the computer 104 calculates the flow rate to each zone 107*a*-107*d*. The process may further be repeated for any desired number of time steps, such that the flow into or out from the perforations of each zone 107*a*-107*d* are monitored over time.

It is noted that the calibration technique described above serves an additional useful purpose. In embodiments in which the fluid 102 is a formation stimulation fluid, such as acid, that is injected into the formation 105, flow rate out from the perforations 110-117 varies throughout the stimulation, and the acoustic noise energy corresponds to the flow rate. If the flow velocity is low, then the sensor settings of the distributed acoustic sensor 108 may be altered to accurately detect the acoustic noise of the flow. For example, in an embodiment in which the distributed acoustic sensor 108 is an optical fiber, a pulse width input to the optical sensor may be increased to increase the sensitivity of the distributed acoustic sensor 108. At a later stage of the stimulation in which the flow rate is much higher, the pulse width may be reduced to prevent data saturation or clipping. The calibration ratio, described above, provides a way for the measurements of acoustic noise and flow rate to be compared to each other, even when they are taken at different sensitivity levels of the distributed acoustic sensor 108 based on pulses of different pulse widths being provided to the distributed acoustic sensor 108. In such an embodiment, the above-described calibration increases the effective dynamic range of the distributed acoustic sensor 108 for stimulation activities.

In one embodiment, the computer 104 further calculates the distributed flow rate in the outer, annular cavity 106. This is done by summing the flow rates of all of the zones 107*a*-107*d* over a period of time t1. In other words, $Q_{distrib,t1}=Q_{a,t1}+Q_{b,t1}+Q_{c,t1}+Q_{d,t1}$. The distributed flow rate $Q_{distrib,t1}$ may then be used with a model based on fundamental and well-understood fluid dynamics to obtain estimates of distributed pressure as a function of time. The distributed pressure may be used in a variety of calculations, such as calculating the effective permeability of the formation 150. In one embodiment, the effective permeability is calculated in real-time, or as the stimulation or extraction operations are being performed within a predetermined time period, such as the time required for the computer 104 for perform the above-described calculations.

In block 204, the computer 104 controls the downhole assembly 101 based on the calculated fluid flow characteristics. For example, as described above, the pulse width of pulses provided to the distributed acoustic sensor 108 may be adjusted according to detected flow rates in the zones 107*a*-107*d*, or a distributed flow rate within the outer, annular cavity 106. In another embodiment, the composition of a stimulation fluid 102 is altered to adjust a downhole flow rate or flow distribution. In another embodiment, the total flow rate is altered at the surface, or by opening or closing valves between the center cavity 105 and the outer, annular cavity 106 to adjust the flow rate in the outer, annular cavity 106 or the flow rate to one or more of the zones 107*a*-107*d*. While a few examples of controlling characteristics of the downhole assembly 101 based on calculated flow rates have been provided, embodiments of the invention are not limited to these examples.

Embodiments of the invention encompass any stimulation or extraction operations, or any operations in which fluid is inserted into a borehole and/or extracted from the borehole.

In one embodiment, the measurement of acoustic noise and calculation of flow rates is performed for formation stimulation activities such as matrix acidizing, hydraulic fracturing, or acid fracturing. In another embodiment, the process of measuring the acoustic noise and calculation of the flow rates is performed during gas injection or water injection. A distributed flow estimate could be used to detect where fluid is entering the formation as well as quantify the effectiveness of a diverter. Embodiments of the invention include various diverter schemes, including chemical and mechanical diversion methods. For acid stimulation work, knowledge of acid placement is useful as it is well understood that a properly selected acid will react with the formation and increase one or both of permeability and porosity. Because a volume of solid is removed from the formation, it will always increase the porosity. Unfortunately this doesn't always mean that the permeability has been altered. A distributed flow measurement could be used to determine the areas where porosity was increased, but may not be used to determine permeability changes. To estimate the change in permeability both a distributed flow and distributed pressure are required as input to a flow model. Accordingly, embodiments of the invention allow for the calculation of permeability changes in an acid stimulation process.

In such an embodiment, a time-varying distributed permeability map can be generated. A distributed permeability estimate is a better stimulation indicator than a distributed flow estimate if the interest is to understand what areas of the well have a reduction in fluid resistance, which is typically the purpose of a stimulation program. In an embodiment in which an initial permeability estimate is measured either during drilling or prior to a stimulation operation, a time-varying distributed skin factor map may be calculated rather than permeability. An estimate of the skin factor as a function of time and space may serve the same purpose as permeability, but may provide a more typical representation of formation resistance changes due to damage or stimulation.

In addition, embodiments of the invention allow for the detection of over-stimulation of a formation 150 leading to a breakdown in a wormhole or pore network causing a reduction in permeability relative to the maximum permeability achieved. A distributed flow estimate alone would not allow for detection of such an occurrence. On the other hand a distributed time-varying permeability estimate, as discussed above according to embodiments of the invention, could identify such a phenomenon quite readily. This information could then be used on future stages or future jobs with similar formation characteristics and/or similar permeability/porosity characteristics as an indication of the amount of cumulative throughput that is expected to result in over-stimulation. Over-stimulation may also be a result of HCl injection without retardation or diversion. In this case a combined distributed flow estimate as well as a distributed permeability estimate could be combined to assess the cause of the over-stimulation.

An estimate of distributed flow, pressure and permeability can also be used in conjunction with prior formation knowledge to minimize the probability of breaking into unwanted zones during acid stimulation. These zones may be gas pockets or zones containing water. This is particularly an issue if the formation has channels of high conductivity and/or has less near wellbore damage relative to other areas of the zone under stimulation. In this case, real-time estimates of the above quantities can be used to alter the stimulation program in real-time. As an example, real-time estimates of the abovementioned quantities can be used to identify a situation where a slice of a zone is taking more acid than other portions of the zone. In this case an adjustment to the stimulation program can be enacted. As one example of a stimulation program adjustment, a diversion agent could be used to plug the area of high permeability that is taking most of the fluid. The diverter could be chemical, mechanical or any one of the many diversion schemes used in stimulation programs.

After a matrix acid stimulation program is complete, the acid must be removed from the formation. While HCl is very efficient at reacting with and removing formation rock, such as carbonate, the reaction can also produce precipitates that plug the formation and reduce the permeability. Treatment fluids that contain emulsions can also cause formation damage. Since the goal of any/most stimulation program is to increase the formation permeability, it is desirable to avoid such reductions in permeability. Typically various fluids and chemicals are included in the stimulation program to prevent such formation damage. This is a rather complex process and it is not always possible to fully mitigate secondary damage. An estimate of the pre-stimulation, during stimulation and post-stimulation distributed permeability could serve to highlight areas that suffer from secondary damage due to precipitates or emulsions. While it may not be easy to detect if reductions in permeability are caused by secondary effects or over-stimulation, the distributed flow estimate according to embodiments of the invention may be used to perform calculations to determined the secondary effects and over-stimulation. A temporal integration of the distributed flow estimate would yield a distributed volume estimate. As over-stimulation is generally synonymous with large volumes of fluid injected, a distributed fluid volume estimate could be employed to differentiate the various causes of a reduction in permeability. In an embodiment in which regions of poor stimulation are attributed to precipitate plugging, a distributed fluid volume estimate could be used in future acid stimulation job designs to alter the chemicals pumped in order to avoid precipitation.

Figure 3:
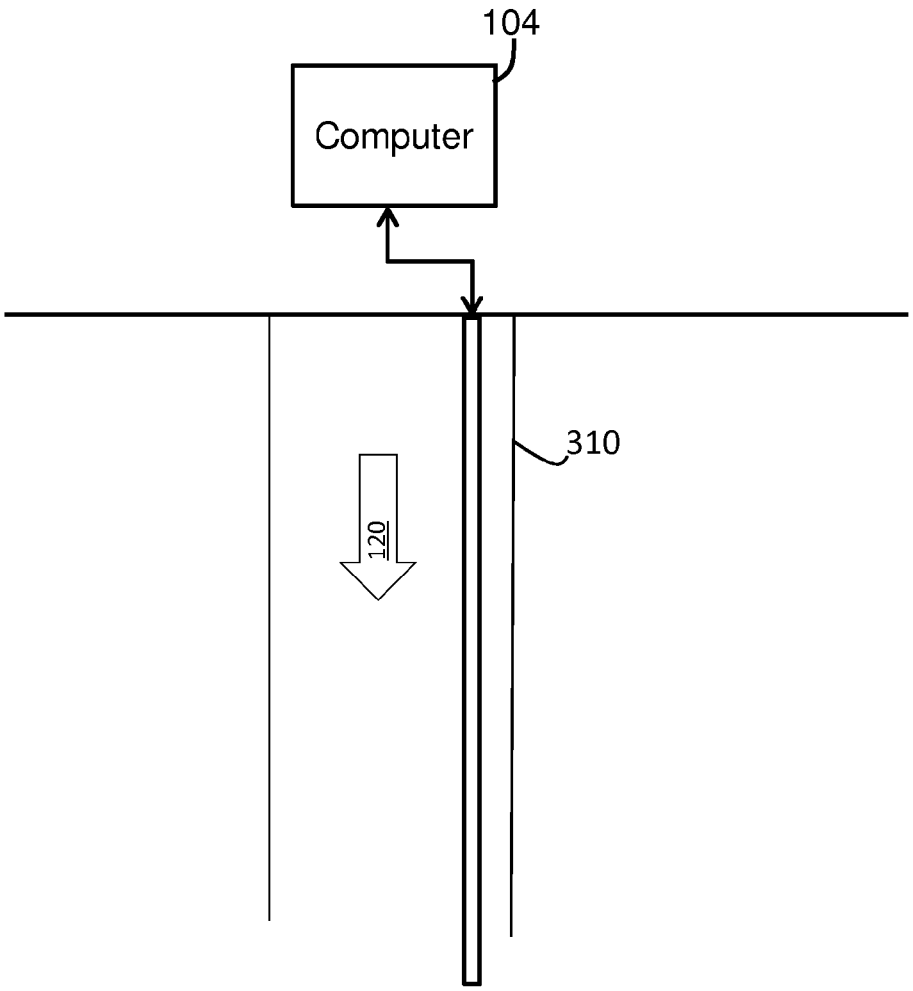
FIG. 3 is a cross sectional view of a fluid flow monitoring system according to an embodiment of the invention.

In alternate embodiments, the above-mentioned calibration procedure (and the preceding procedure to select frequency bands that are highly correlated with flow velocity) to develop a calibration factor from flow velocity to acoustic energy can also be applied to other flow conditions. While the specific embodiment detailed above relates to flow into or out of perforations such that the fluid flow is perpendicular to the axial direction of production tubing and casing, this same methodology could be applied to axial flow along the axial length of production tubing or casing within the formation 150 (axial flow is indicated by 120 in FIG. 1, for example). Thus, the above-described system and method may additionally prove useful for estimating flow from a particular zone, assuming there was a section of unperforated casing between each zone. The system and method described above may also serve as an alternative to an uphole total flow meter once calibrated. In this case the axial flow through the upper completion would be leveraged. These examples of axial flow are not exhaustive but, rather, illustrative of scenarios for calibrated axial flow rate estimate from an acoustic measurement. FIG. 3 is a cross sectional view of a fluid flow monitoring system according to an embodiment of the invention. The embodiment shown in FIG. 3 relates to determining flow rate of axial fluid flow (120) in tubing or casing 310. The tubing or casing 310 may be used in production, for example, or in drilling or other downhole efforts. The distributed sensor array 108 is disposed in the tubing or casing 310 and is coupled to the computer 104. As detailed above, the computer 104 determines the flow rate (of axial fluid flow 120 in this case) based on the distributed sensor array 108 output.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of monitoring fluid flow in a borehole, comprising:

measuring acoustics at a plurality of locations along a downhole assembly in the borehole; and calculating a fluid flow rate at the plurality of locations along the downhole assembly based on measuring the acoustics at the plurality of locations, wherein the calculating the fluid flow rate at each of the plurality of locations is based on a computation using total fluid flow rate at a surface location and a sum of the acoustics measured at the plurality of locations at a same time, wherein calculating the fluid flow rate comprises:

determining the fluid flow rate at the surface location outside the borehole;

determining the sum of acoustic measurements at the plurality of locations along the downhole assembly; and calculating the fluid flow rate at each of the plurality of locations according to an equation:

$$(Q_{tot,t1}/\mathrm{MEAS}_{tot,t1})*\mathrm{MEAS}_{a,t1}\ldots(Q_{tot,t1}/\mathrm{MEAS}_{tot,t1})*\mathrm{MEAS}_{n,t1},$$

wherein $Q_{tot,t1}$ represents a total fluid flow rate at the surface location at a time t1, $\mathrm{MEAS}_{tot,t1}$ represents the sum of acoustic measurements at the plurality of locations at the time t1 $\mathrm{MEAS}_{a,t1}$ represents an acoustic measurement at one of the plurality of locations (a) at the time t1 and $\mathrm{MEAS}_{n,t1}$ represents an acoustic measurement at an nth one of the plurality of locations at the time t1.

2. The method of claim 1, wherein the sum of the acoustic measurements is over a selected band of frequencies, the selected band of frequencies being selected based on correlation with the fluid flow rate.

3. The method of claim 1, wherein measuring the acoustics at the plurality of locations comprises surveying an optical fiber extending along the downhole assembly to measure characteristics corresponding to acoustics at the plurality of locations along the downhole assembly.

4. The method of claim 1, wherein the plurality of locations correspond to perforations in the downhole assembly to allow fluid flow between an inside of the downhole assembly and an earth formation.

5. The method of claim 4, wherein measuring the acoustics includes measuring acoustics of fluid flowing through the perforations.

6. The method of claim 4, wherein measuring the acoustics includes measuring acoustics of acid flowing from inside the downhole assembly into the earth formation.

7. The method of claim 4, wherein measuring the acoustics includes measuring acoustics of fluid flowing from the earth formation into the downhole assembly.

8. The method of claim 1, further comprising:

calculating a flow distribution among the plurality of locations based on calculating the fluid flow rate at the plurality of locations along the downhole assembly.

9. The method of claim 8, further comprising:

adjusting one or both of a flow rate of a fluid to one or more of the plurality of locations and a composition of the fluid based on calculating the flow distribution.

10. A wellbore system, comprising:

a downhole assembly having a plurality of locations along the downhole assembly including perforations to permit fluid flow between an inside of the downhole assembly and an earth formation, the downhole assembly including a distributed sensor assembly configured to measure acoustics at the plurality of locations;

a fluid flow monitor to measure a total fluid flow rate of fluid injected into or leaving the downhole assembly; and a computer configured to calculate a fluid flow rate at the plurality of locations along the downhole assembly based on measurements from the distributed sensor assembly corresponding to the acoustic s at the plurality of locations, and based on the total fluid flow rate, wherein the calculation uses flow rate at a surface location and a sum of the measurements corresponding to the acoustics at the plurality of locations at a same time, wherein the computer is configured to calculate the fluid flow rate at the plurality of locations based on the following formula:

$$(Q_{tot,t1}/\mathrm{MEAS}_{tot,t1})*\mathrm{MEAS}_{a,t1}\ldots(Q_{tot,t1}/\mathrm{MEAS}_{tot,t1})*\mathrm{MEAS}_{n,t1},$$

wherein $Q_{tot,t1}$ represents the total fluid flow rate at the surface location at a time t1, $\mathrm{MEAS}_{tot,t1}$ represents the sum of acoustic measurements at the plurality of locations at the time t1 $\mathrm{MEAS}_{a,t1}$ represents an acoustic measurement at one of the plurality of locations (a) at the time t1, and $\mathrm{MEAS}_{n,t1}$ represents an acoustic measurement at an nth one of the plurality of locations at the time t1.

11. The wellbore system of claim 10, wherein the sum of the acoustic measurements is over a selected band of frequencies, the selected band of frequencies being selected based on correlation with the fluid flow rate.

12. The wellbore system of claim 10, wherein the distributed sensor assembly includes an optical fiber extending along the downhole assembly at all of the plurality of locations, and the optical fiber is configured to deform based on acoustics of a fluid in the downhole assembly.

13. The wellbore system of claim 10, wherein the distributed sensor assembly is configured to measure acoustics of fluid flowing through the perforations.

14. The wellbore system of claim 10, further comprising an acid source at the surface outside the wellbore, wherein the distributed sensor assembly is configured to measure acoustics of acid flowing from inside the downhole assembly into the earth formation.

15. The wellbore system of claim 10, wherein the downhole assembly is a completion assembly for extracting fluid from an earth formation, and the distributed sensor assembly is configured to measure acoustics of the fluid flowing from the earth formation into the downhole assembly.

16. The wellbore system of claim 10, wherein the computer is configured to calculate a flow distribution among the plurality of locations based on calculating the fluid flow rate at the plurality of locations along the downhole assembly.

17. The wellbore system of claim 10, wherein the computer is further configured to adjust one or both of a flow rate of the fluid to one or more of the plurality of locations and a composition of the fluid.

* * * * *